US006383009B2

(12) United States Patent
Kawase et al.

(10) Patent No.: US 6,383,009 B2
(45) Date of Patent: May 7, 2002

(54) FITTING DETECTING CONNECTOR

(75) Inventors: Hajime Kawase; Satoru Nishide; Ryotaro Ishikawa, all of Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/754,398

(22) Filed: Jan. 5, 2001

Related U.S. Application Data

(63) Continuation of application No. 09/357,891, filed on Jul. 21, 1999, now abandoned.

(30) Foreign Application Priority Data

Aug. 20, 1998 (JP) ..... 10-234596

(51) Int. Cl.[7] ..... H01R 13/627
(52) U.S. Cl. ..... 439/352; 439/489
(58) Field of Search ..... 439/488–490, 439/352, 310

(56) References Cited

U.S. PATENT DOCUMENTS 5,791,930 A * 8/1998 Tabata et al. ..... 439/352
5,820,399 A * 10/1998 Shirouzu et al. ..... 439/352
5,848,919 A * 12/1998 Okabe ..... 439/489
5,919,056 A * 7/1999 Suzuki et al. ..... 439/352

* cited by examiner

*Primary Examiner*—Hien Vu
(74) *Attorney, Agent, or Firm*—Banner & Witcoff, Ltd.

(57) ABSTRACT

A spring holder 25 containing coiled springs 41 is installed in a female housing 11. When a male housing 1 and this female housing 11 are fitted together, a locking arm 20 rises over a stopping protrusion 7, a restraining wall 39 simultaneously engages a locking claw 22, and the coiled springs are compressed. The locking claw 22 makes contact with a contacting face of the restraining wall 39, this contacting face being a tapered face 40. When the locking arm 20 is about to pass over the stopping protrusion 7 to return to its original position, the restraining wall 39 receives a spring force F from the coiled springs and pushes the locking arm 20. A component force F1 in a returning direction of the locking arm 20 is obtained from this spring force F due to the tapered face 40. The component force F1 and the returning force of the locking arm 20 itself cause the locking arm 20 to return smoothly, and the locking arm 20 thus engages with the stopping protrusion 7.

5 Claims, 11 Drawing Sheets

FITTING DETECTING CONNECTOR

This application is a continuation application of application Ser. No. 09/357,891 filed Jul. 21, 1999, now abandoned.

TECHNICAL FIELD

The present invention relates to a fitting detecting connector.

BACKGROUND TO THE INVENTION

Disclosed in JP-9-211020 is a fitting detecting connector in which, when male and female connector housings are not correctly fitted together, force from a spring pushes the housings apart, and in which a locking arm is provided on one of the connector housings, this locking arm maintaining the two connector housings and the spring in a fitted state.

The configuration of this fitting detecting connector is explained briefly below with the aid of FIG. 19. A male housing a fitting together with a female housing c has a stopping protrusion b. The corresponding female housing c has a bendable locking arm d for engagement by the stopping protrusion b and a spring holder e capable of being moved in an anterior-posterior direction. Coiled springs f are housed within this spring holder e, these coiled springs f being compressed by an anterior edge of the male housing a. When the two housings a and c are fitted together, the locking arm d rises over the stopping protrusion b, and a tip of the locking arm d is engaged by a restraining wall g of the spring holder e (see FIG. 20), thereby regulating the movement in a posterior direction of the spring holder e. As a result, as the two housings a and c are being fitted together, the coiled springs f are pressed down and gradually compressed by the anterior edge of the male housing a. If the fitting operation is halted at this state, the resilient spring force of the coiled springs f separates the two housings a and c. If the housings a and c are completely fitted together, the locking arm d rises over the stopping protrusion b, thereby returning to its original shape and being engaged by the stopping protrusion b. Then the engagement of the spring holder e is released, and the resilient spring force of the coiled springs f pushes the spring holder e in a posterior direction.

However, as shown in FIG. 20, when the locking arm d rises over the stopping protrusion b and returns to its original position, the resilient spring force of the coiled springs f is sometimes exerted from the restraining wall g of the spring holder e towards the tip of the locking arm d, as shown by the arrow in FIG. 20, thus regulating the return of the locking arm d. That is, there is the possibility that locking cannot occur even though the two housings a and c have been correctly fitted together, and thus further improvement is required.

The present invention responds to the above shortcoming, and aims to present a fitting detecting connector in which the locking arm returns smoothly to its original position when the two connector housings have been correctly fitted together.

SUMMARY OF THE INVENTION

According to the invention there is provided a connector housing of a male/female connector pair, the housing including a locking arm bendable from a rest condition to a bent condition on initial engagement with a locking member of a mating connector, and reverting to the rest condition on complete engagement of said locking arm and locking member, the housing further including a compression spring having one end engageable with a mating connector to urge said housing out of engagement therewith during partial fitting thereof, and a spring holder defining a releasable reaction member for the other end of said spring, said locking arm and spring holder being engageable during partial fitting to make said reaction member effective, and being released on complete engagement of said locking arm and locking member to make said reaction member ineffective, and thereby permit compressive stress in said spring to be reduced, wherein engagement between said locking arm and spring holder is by abutment, one of said locking arm and spring holder having a tapered abutment face such that the load of said spring includes a component tending to return said locking arm to the rest condition.

Other features of the invention will be disclosed in the following description of several preferred embodiments shown by way of example only in the accompanying drawings in which.

DESCRIPTION OF PREFERRED EMBODIMENTS

Figure 1:
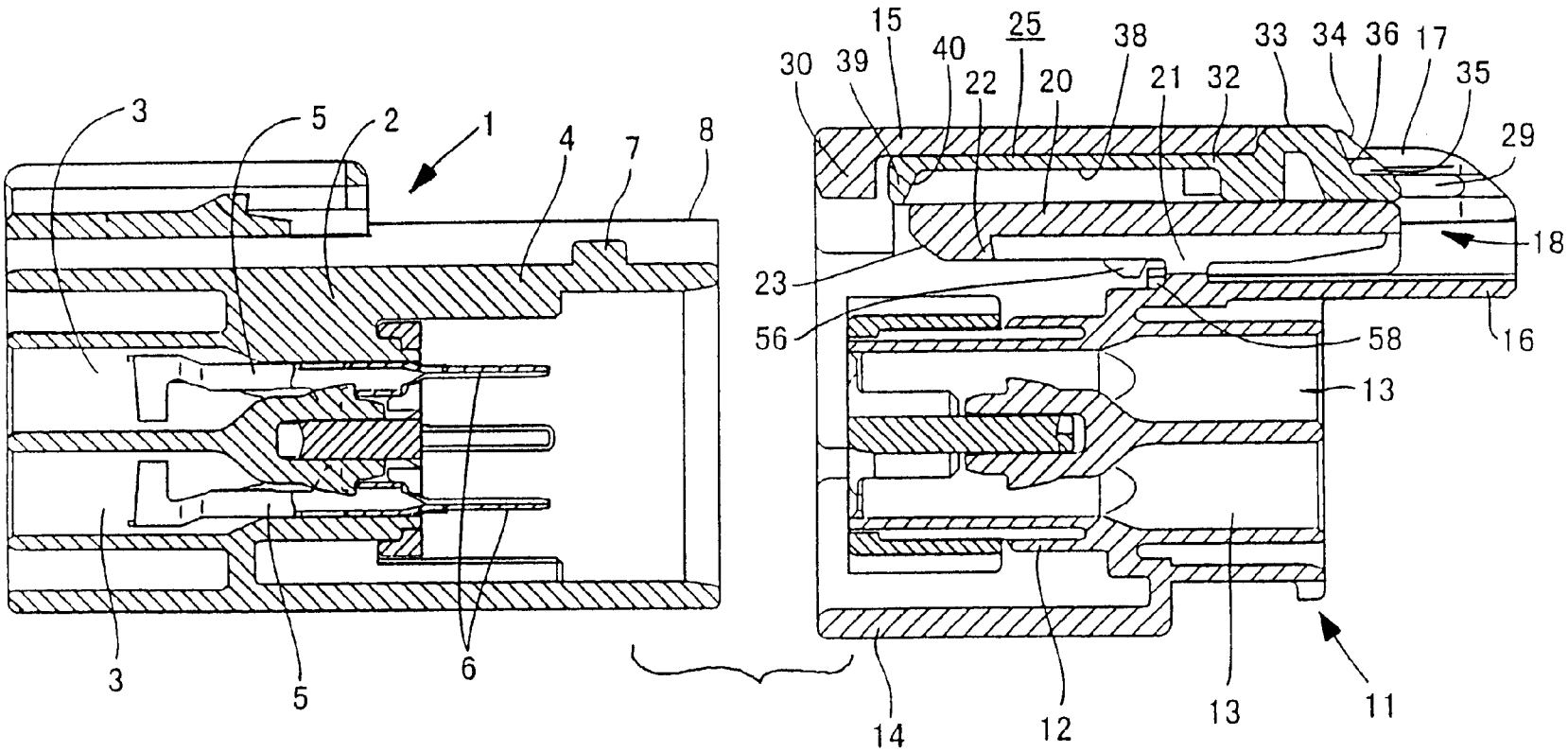
FIG. 1 is a vertical cross-sectional view showing two housings of a first embodiment of the present invention prior to their being fitted together.

A first embodiment of the present invention is described below with the aid of FIGS. 1 to 16. As FIG. 1 shows, this embodiment is provided with a male connector housing 1 (hereafter referred to as male housing) fitting with a female connector housing 11 (hereafter referred to as female housing). Mutually fitting faces of the housings 1 and 11 will be considered to be anterior faces.

The male housing 1 is made from plastic and is part of an electrical apparatus (not shown). Eight cavities 3 are formed as two upper and lower layers in a main member 2 of the male housing 1, and a tubular fitting cylinder 4 is formed on an anterior face of the main member 2. Male terminal fittings 5 are inserted into each cavity 3, tabs 6 of these male terminal fittings 5 protruding into the fitting cylinder 4 and being housed therein in a state that prevents removal. A stopping protrusion 7 is formed on an upper face of the fitting cylinder 4 at a location close to an anterior edge thereof which faces the female connector housing 11, a pair of left and right ribs 8 protruding upwards in a mutually parallel manner from both sides of the stopping protrusion 7, these ribs 8 extending in an axial direction.

Figure 3:
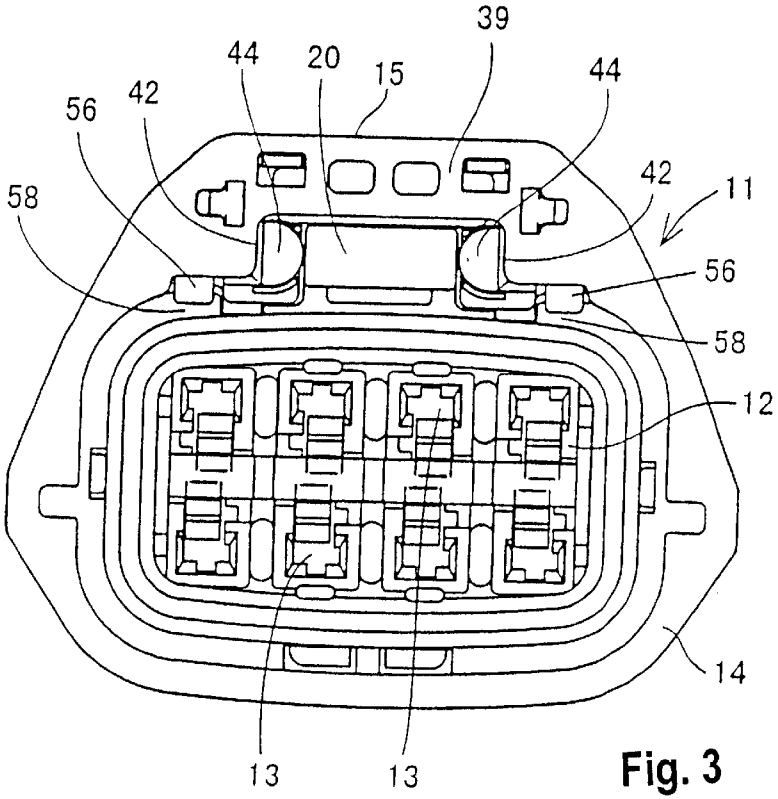
FIG. 3 is a front face view of the female housing.

The female housing 11 is also made from plastic and, like the male housing 1, has a main body 12 in which eight cavities 13 are formed as two upper and lower layers. Female terminal fittings (not shown) are housed in the cavities 13 in a state that prevents removal. As shown in FIG. 3, the anterior half of the main body 12 is surrounded by an external cylinder member 14 which is open towards the anterior side. The central portion of the upper face of the external cylinder member 14 protrudes in an upper direction and forms an arch member 15. As shown in FIG. 1, a ceiling face of this arch member 15 extends to a location slightly before the posterior face of the main body 12. Further, an upper face of the main body 12 extends to the posterior for a prescribed distance to an extending face 16. Side walls 17 are formed on both sides of this extending face 16 and link side walls of the arch member 15. A housing space 18 for a spring holder 25 (to be explained) is formed in the centre of the extending face 16.

A locking arm 20 is provided in this housing space 18 to support the two housings 1 and 11 in a fitted state. This locking arm 20 is provided in an anterior-posterior direction from a location slightly behind the anterior face of the main body 12 to a location protruding slightly to the posterior of the posterior face thereof. The approximately central portion in a length-wise direction of the locking arm 20 being joined to the upper face of the main body 12 by a joining member 21. This joining member 21 serves as a fulcrum so that the locking arm 20 is movable in a seesaw fashion in the anterior and posterior directions. The anterior end of the locking arm 20 has a hook-shaped locking claw 22. When the two housings 1 and 11 are in a completely fitted state, this locking claw 22 is engaged by the posterior face side of the stopping protrusion 7, and maintains the two housings 1 and 11 in a fitted state. In addition, the anterior end face of the locking claw 22 has a tapered face 23 which tapers towards the inner side, and which allows the locking claw 22 to rise smoothly over the stopping protrusion 7.

Figure 6:
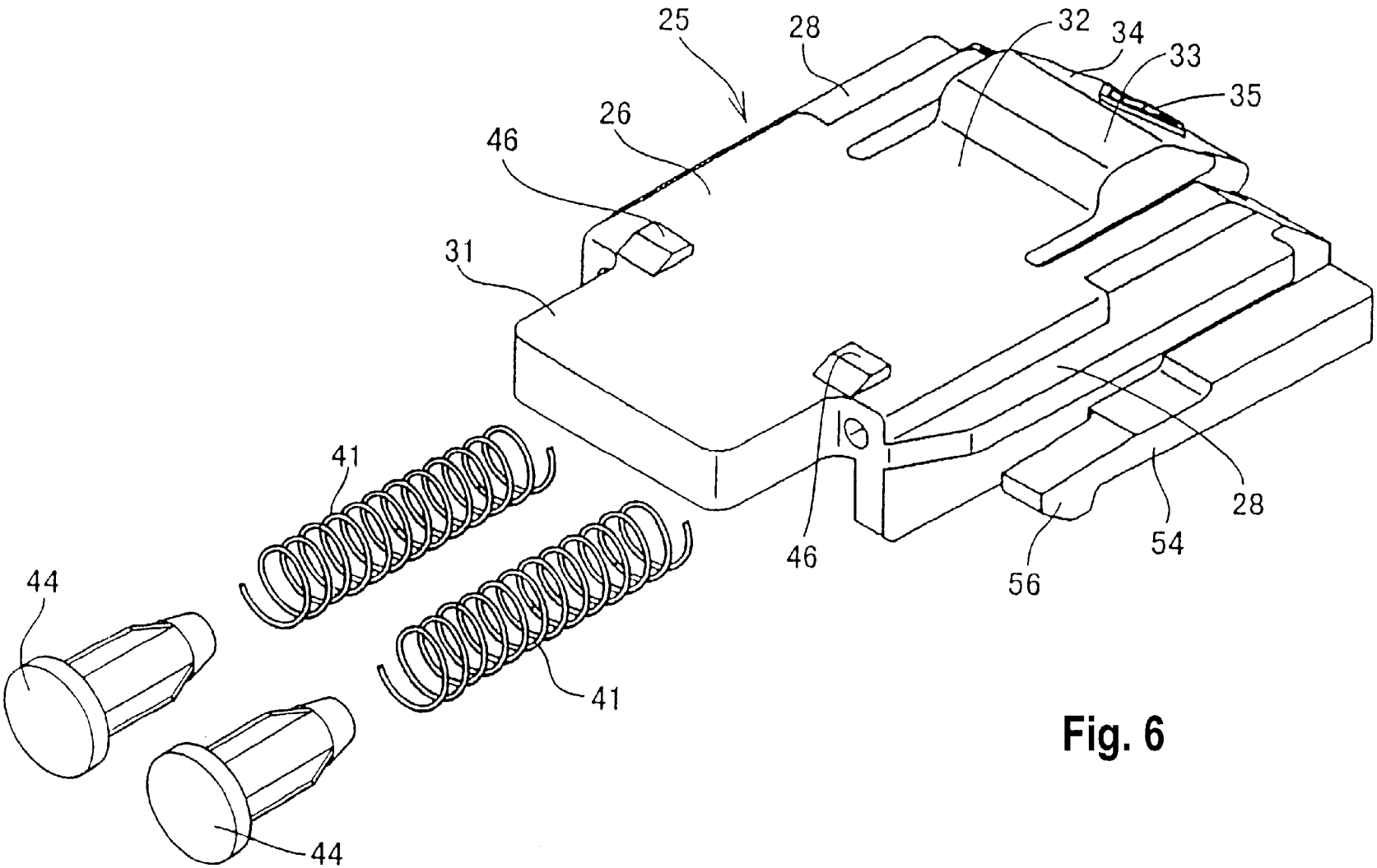
FIG. 6 is a disassembled diagonal view of a spring holder.

The spring holder 25 is formed in the housing space 18 so as to cover the locking arm 20. When this spring holder 25 contains coiled springs 41 (to be described later), the two are treated as a single unit. The spring holder 25 and the coiled springs 41 are contained as a single unit within the housing space 18. As shown in FIG. 6, the spring holder 25 has a plate shaped base plate 26, the anterior end thereof being narrow. A pair of spring housing members 27 extend from front to rear on the left and right sides of the lower face of this base plate 26 and are on either side of the locking arm 20 (see FIG. 7).

A pair of guiding rails 28 extend for approximately the entire length along both left and right sides of the spring holder 25. The anterior ends of these two guiding rails 28 are tapered. Grooves 29 which are provided on left and right inner walls of the housing space 18 of the female housing 11 correspond with the guiding rails 28 and allow the guiding rails 28 to be fitted in such a way that they can slide to the anterior and posterior. These grooves 29 being open at the posterior face side. Consequently, the spring holder 25 is inserted from this posterior face side with the left and right guiding rails 28 of the spring holder 25 fitting with the corresponding grooves 29, and the base plate 26 of the spring holder 25 being inserted between the ceiling face of the arch member 15 and the upper face of the locking arm 20.

The anterior end of the ceiling face of the arch member 15 has a depending protecting wall 30. When the spring holder 25 is inserted, this protecting wall 30 makes contact with a tip of a narrow member 31 of the spring holder 25 to thereby regulate the anterior movement of the spring holder 25. Furthermore, when the spring holder 25 is attached, the protecting wall 30 also protects the tip of the narrow member 31 from unwanted external forces.

Figure 2:
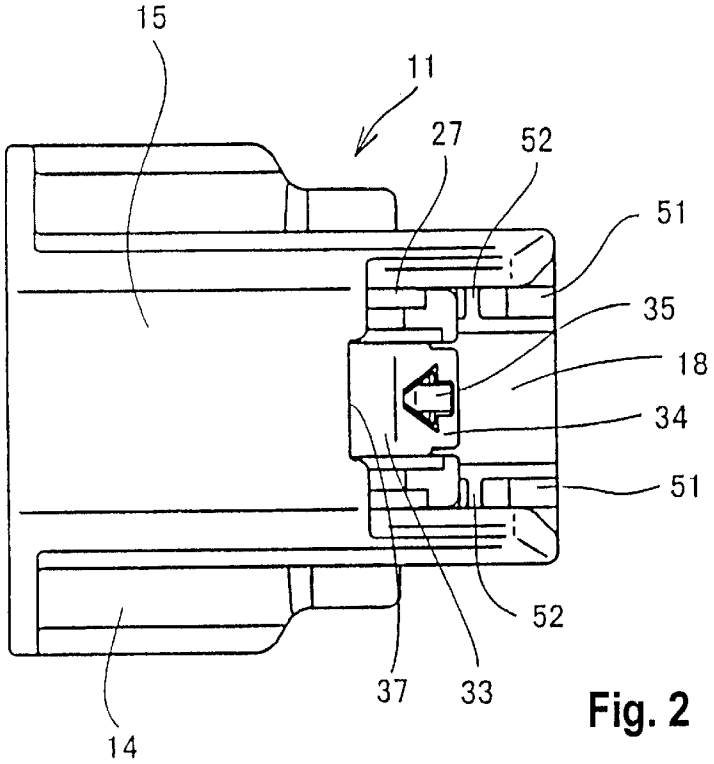
FIG. 2 is a plan view of a female housing.

As shown in FIG. 2, when the spring holder 25 has been inserted in the above manner to an advanced position of the housing space 18, a portion of the posterior end of the spring holder 25 protrudes slightly to the posterior of the arch member 15. This protruding portion corresponds to the upper face of the posterior edge of the locking arm 20, and a releasing operating member 32 is formed on this posterior edge to allow the release of the lock of the locking arm 20. As shown in FIG. 6, slits are formed along both sides of the releasing operating member 32 which allow it to bend in an up-down direction. The releasing operating member 32 has a cantilevered shape, the anterior end portion thereof being higher and forming an operating stepped member 33. The posterior face angled side of this operating stepped member 33 is tapered and forms an operating face 34. A jig hole 35 is formed therein, and a jig such as a small screwdriver is inserted into this jig hole 35. Moreover, a vertical contacting face 36 is formed diagonally in the jig hole 35 (see FIG. 1).

As shown in FIG. 2, the central portion in a width-wise direction of the posterior edge of the arch member 15 has a concave recess 37. When the spring holder 25 has been inserted to the advanced position, the anterior end of the operating stepped member 33 fits with this recess 37.

The inner face of the base plate 26 of the spring holder 25 has the same width as the releasing operating member 32 and has a recess 38 set back from the anterior edge. This recess 38 allows the locking arm 20 to bend when it rises over the stopping protrusion 7 while the two housings 1 and 11 are being fitted together.

The anterior wall of the recess 38 forms a restraining wall 39 which stops the anterior end of the locking member 20 and regulates the retreating operation of the spring holder 25 (explained in detail later). A contacting face of this restraining wall 39 is a tapered face 40 which becomes thicker towards the top.

Figure 7:
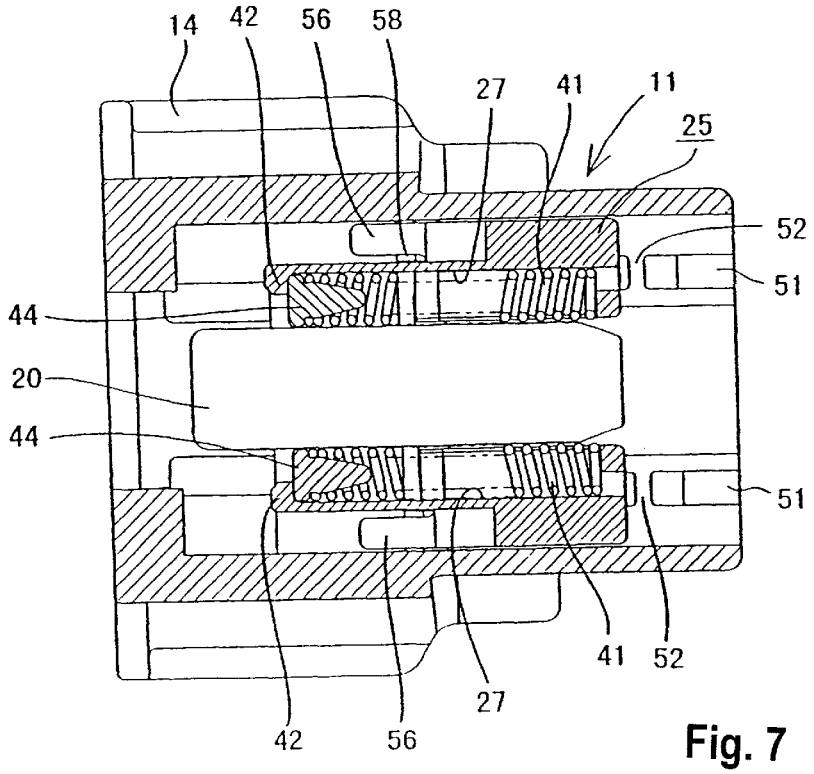
FIG. 7 is a plan cross-sectional view of the installed portion of coiled springs of the female housing.

The spring housing members 27 of the spring holder 25 each house a coiled spring 41 horizontally and in an approximately natural state. As FIG. 7 shows, only half of the anterior face of each spring housing member 27 is open. A pair of halting members 42 are formed on the anterior ends of the spring housing members 27. These halting members 42 cover half of the external face of each spring housing member 27. Each anterior end of the two coiled springs 41 is equipped with a spring seat 44. These two spring seats 44 make contact with the inner side of the halting members 42 and thereby prevent the removal of the coiled springs 41 in an anterior direction. Further, the portions of the spring seats 44 which protrude from the halting members 42 correspond to the location of the ribs 8 of the male housing 1 when the male and female housings 1 and 11 are being fitted together. As a result, while the fitting is taking place the ribs 8 compress the coiled springs 41 via the corresponding spring seats 44.

Figure 5:
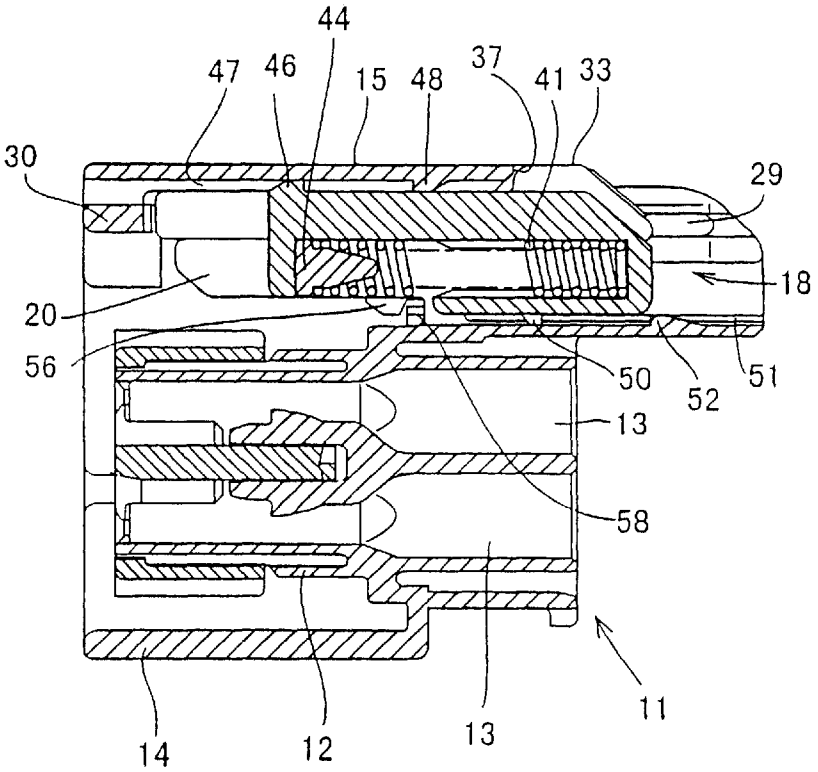
FIG. 5 is a vertical cross-sectional view of an installed portion of coiled springs of the female housing.
Figure 4:
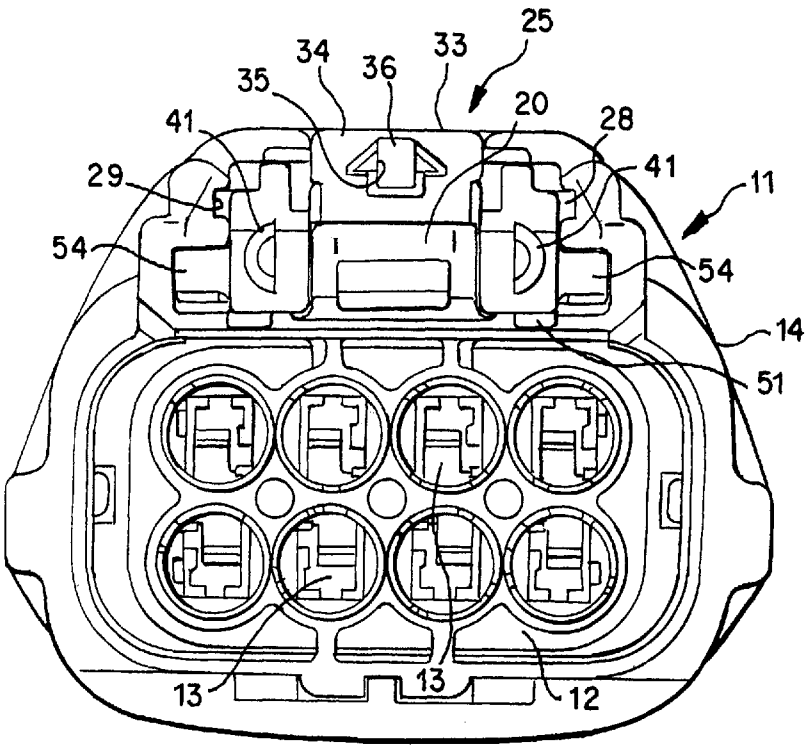
FIG. 4 is a rear face view of the female housing.

A pair of left and right upper edge protrusions 46 are formed on the upper face of the base plate 26 of the spring holder 25 close to the base of the narrow member 31. As FIG. 5 shows, these upper edge protrusions 46 fit into a recessed groove 47 formed in an anterior-posterior direction on the ceiling face of the arch member 15. In the half-fitted position, upper edge stopping protrusions 48 formed on the ceiling face of the arch member 15 are stopped by the upper edge protrusions 46. Further, a pair of left and right lower edge protrusions 50 are formed on the spring housing members 27 close to the posterior end of the lower face thereof, these lower edge protrusions 50 fitting into a recessed groove 51 formed in an anterior-posterior direction on the base face of the housing space 18 (the extending face 16). In the half-fitted position, lower edge stopping protrusions 52 formed on the base face of the housing space 18 are engaged by the lower edge protrusions 50. When the restraining of the spring holder 25 is released and the retreating operating thereof occurs, the upper edge protrusions 46 make contact with the upper edge stopping protrusions 48 and the lower edge protrusions 50 make contact with the lower edge stopping protrusions 52, thereby regulating the retreat of the spring holder 25.

Figure 12:
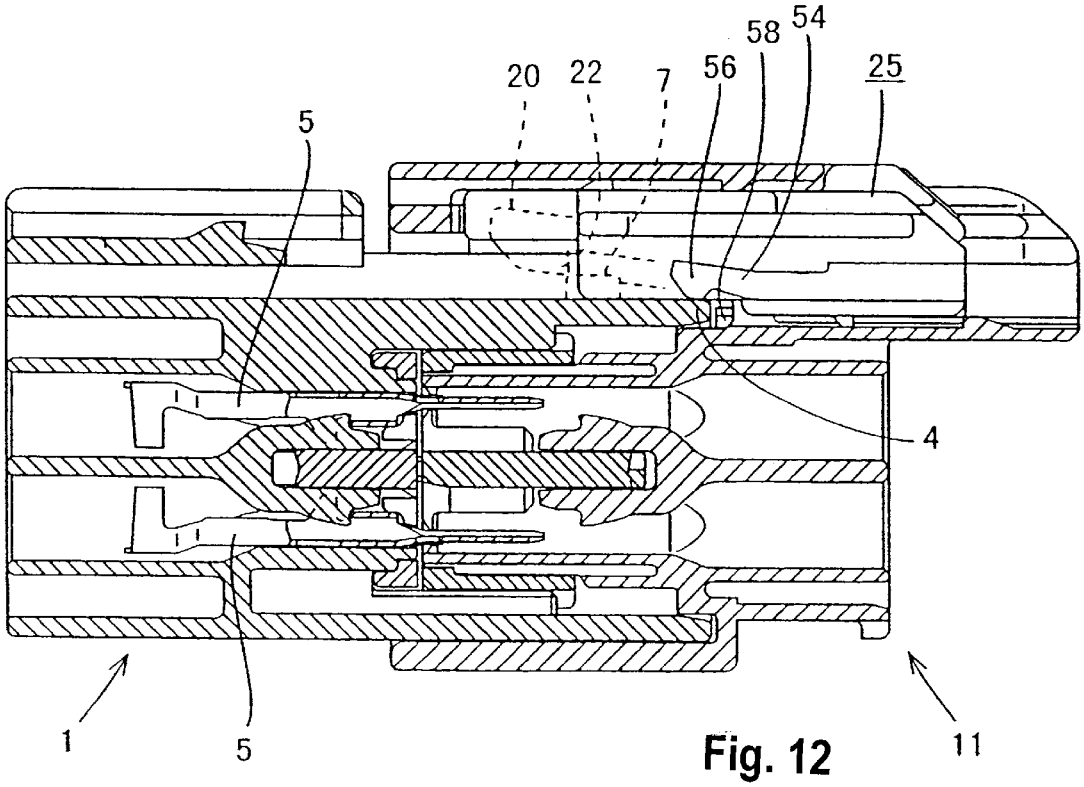
FIG. 12 is a vertical cross-sectional view showing a supporting arm separated from a hook member.

A pair of supporting arms 54 protrude from the outer side faces of the two spring housing members 27. The base ends of the supporting arms 54 are located at the posterior end of the spring holder 25 and the supporting arms 54 extend horizontally in an anterior direction along the side walls of the spring housing members 27 and have a cantilevered shape, the anterior ends thereof being provided with stopping claws 56. These allow the supporting arms 54 to be bent in an up-down direction, and can be removably engaged by a pair of hook members 58 (see FIG. 3 and FIG. 12) located in a corresponding position on the upper face of the main body 12. In this manner, the spring holder 25 is supported in the advanced position. Further, as shown in FIG. 12, the stopping claws 56 of the supporting arms 54 make contact with the anterior edge of the fitting cylinder 4 of the male housing 1 and, as the two housings 1 and 11 are fitted together, the engagement of the hook members 58 is released. This engagement is released jut before the engagement of the spring holder 25 by the locking arm 20 is released (see FIG. 10).

Figure 8:
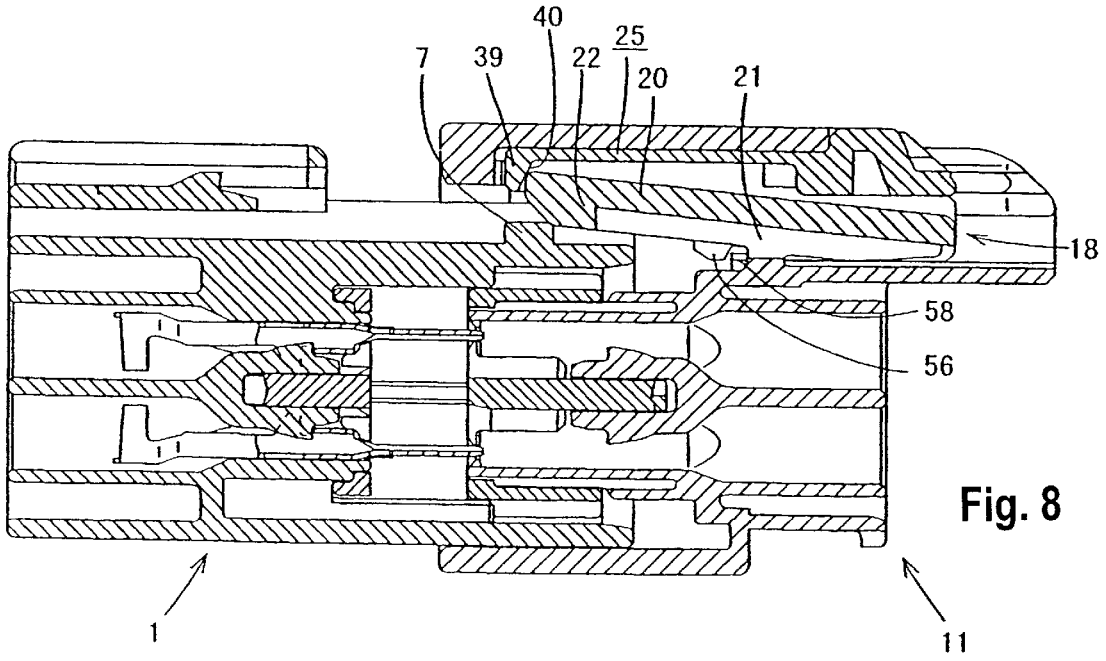
FIG. 8 is a vertical cross-sectional view showing a locking arm in contact with a stopping protrusion.

In operation, the spring holder 25 is inserted into the housing space 18 of the female housing 11 and, as shown in FIG. 1, is attached in the advanced position. Next, the male and female housings 1 and 11 are fitted together, and the locking claw 22 of the locking arm 20 makes contact with the stopping protrusion 7 of the male housing 1 and, as shown in FIG. 8, rises over the stopping protrusion 7. As a result, the locking claw 22 is engaged by the restraining wall 39 of the spring holder 25.

Figure 9:
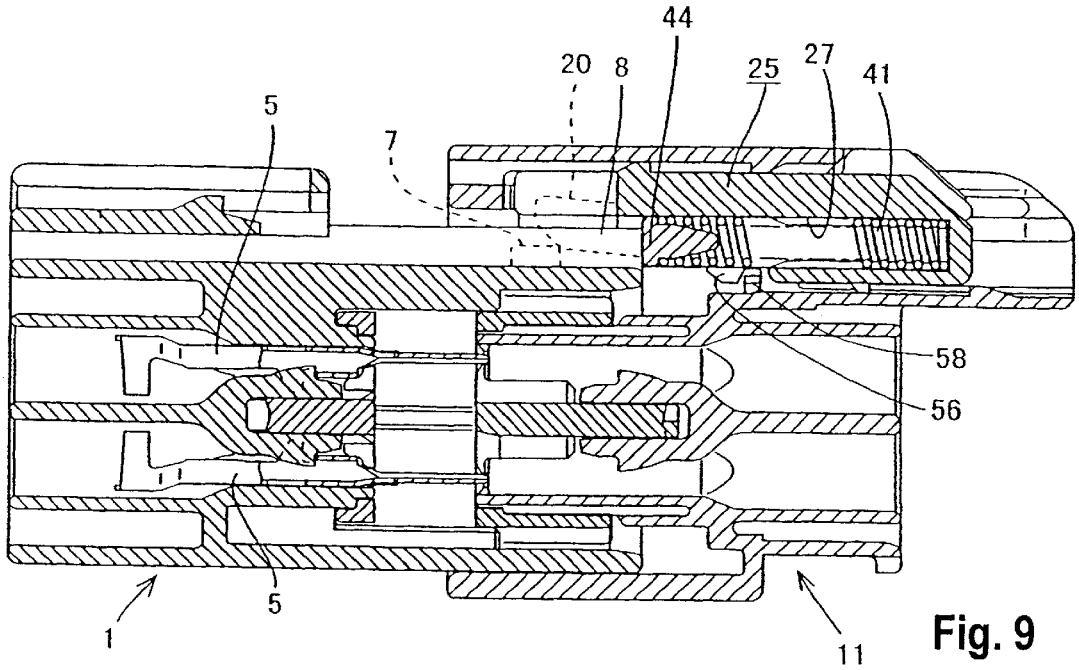
FIG. 9 is a vertical cross-sectional view showing the coiled springs after compression has begun.
Figure 10:
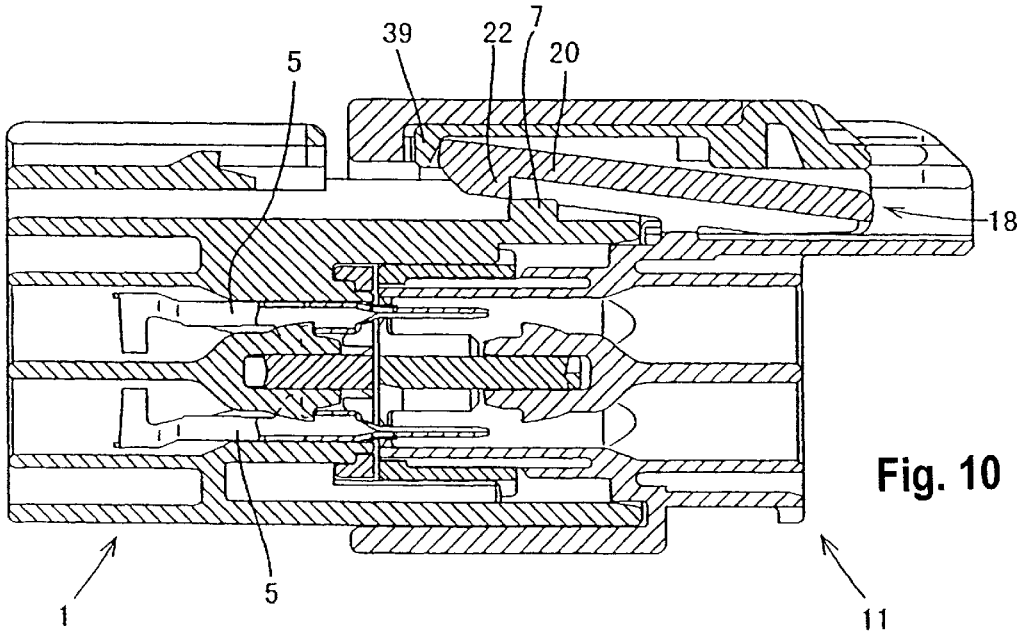
FIG. 10 is a vertical cross-sectional view showing the locking arm immediately prior to rising over the stopping protrusion.
Figure 11:
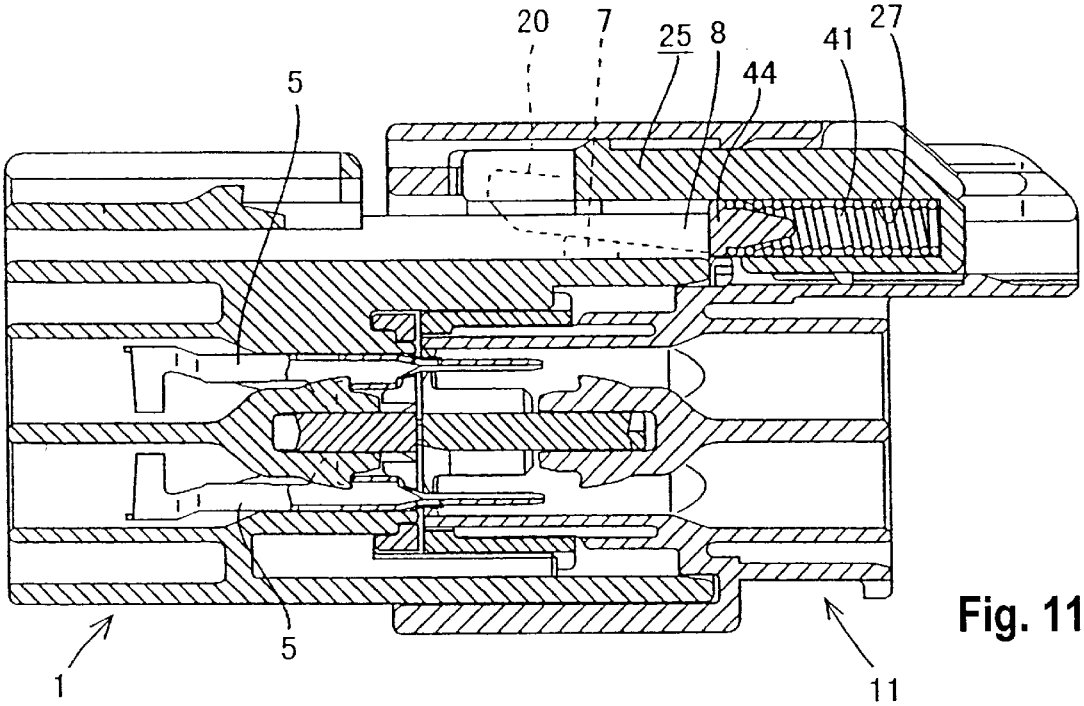
FIG. 11 is a vertical cross-sectional view showing the compressed state of the coiled springs at the same juncture as FIG. 10.

As shown in FIG. 9, slightly after the locking claws 22 and the stopping protrusion 7 make contact, the two ribs 8 make contact with the corresponding springs seats 44 and, as the fitting operation continues, the two coiled springs 44 are pushed in. At this juncture, as mentioned above, the spring holder 25 is engaged by the locking arm 20 and the restraining wall 39, and its movement in a posterior direction is thus regulated. Consequently, the two coiled springs 41 are restrained at their posterior end and the coiled springs 41 begin to be compressed by the ribs 8 as the latter are pushed in. During the interval preceding the regulation of the movement of the spring holder 25 by the locking arm 20, the stopping claws 56 of the two supporting arms 54 are in a state whereby they are engaged by the hook members 58. As a result, even if the coiled springs 41 are pushed in for any reason, the spring holder 25 will not retreat inadvertently.

The fitting operation of the two housings 1 and 11 continues after the two supporting arms 54 have been engaged by the hook members 58. In the state directly prior to the housings being completely fitted together, that is, in the state directly prior to the locking claw 22 rising over the stopping protrusion 7 (the state shown in FIGS. 10 and 11), as shown in FIG. 12, the anterior edge of the male housing 1 makes contact with the tapered face of the stopping claws 56 located on the supporting arms 54, raising the anterior ends of the two supporting arms 54. As a result, the engagement of the stopping claws 56 and the hook members 58 is released. That is, this releasing operating precedes the releasing operation of the spring holder 25 by the locking arm 20.

Furthermore, if the fitting operation of the two housings 1 and 11 is halted at this juncture, that is, in a half-fitted state, the spring force of the two coiled springs 41 pushes the male housing 1 away from the female housing 11 until the male and female terminal fittings reach a non-conducting state.

Figure 13:
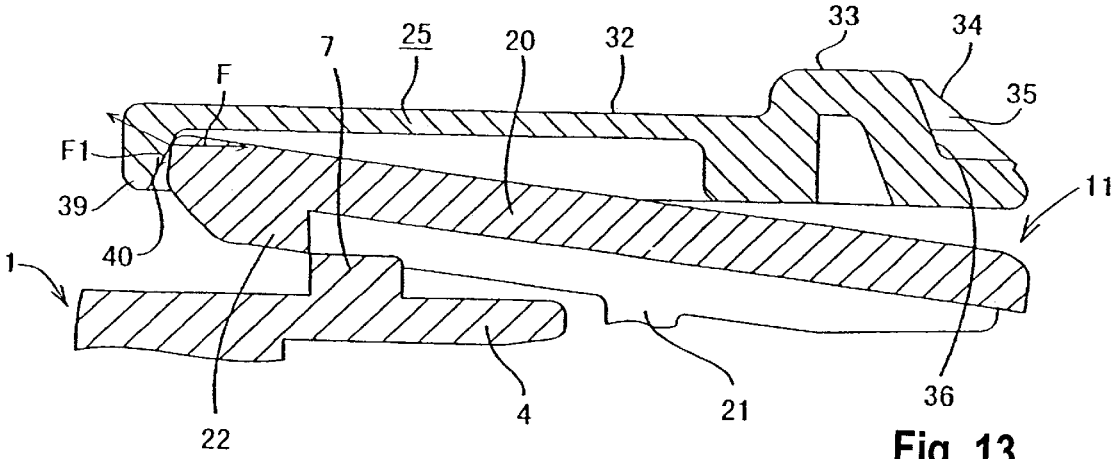
FIG. 13 is a partially enlarged cross-sectional view showing the locking arm having passed over the stopping protrusion.
Figure 14:
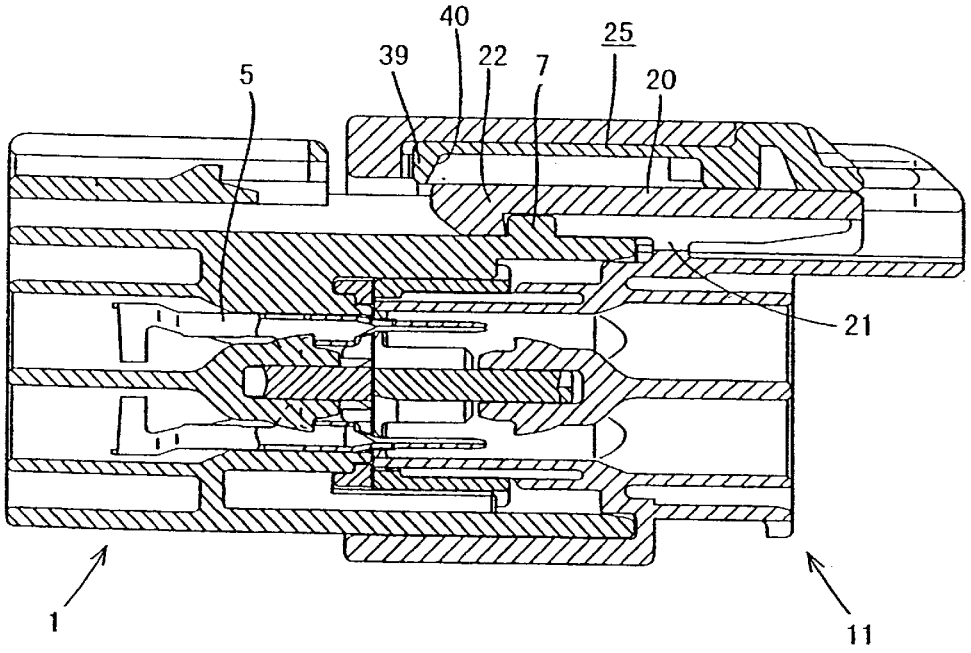
FIG. 14 is a vertical cross-sectional view showing the locking arm in a returned state.

As shown in FIG. 13, when the two housings 1 and 11 are fitted together in a correct fitting position, the locking claw 22 of the locking arm 20 rises over the stopping protrusion 7, and the locking arm 20 reaches a state in which it can revert to its original position. At this juncture, the restraining wall 39 is pushed onto the anterior end of the locking arm 20, and the spring force F of the coiled springs 41 is exerted in a horizontal direction. Along with this, there is the danger that the frictional force between the restraining wall 39 and the anterior end of the locking arm 20 may prevent the locking arm 20 from returning. However, the contacting face of the restraining wall 39 is the tapered face 40, and, consequently, the spring force F of the coiled springs 41 extends along the tapered face 40, resulting in a component force F1. This causes the locking arm 20 to move in a returning direction. As shown in FIG. 14, the component force F1 as well as the resilient returning force of the locking arm 20 itself cause the locking arm 20 to return smoothly to its original position.

As a result, the locking claw 22 is released from the restraining wall 39 and, consequently, the restraint of the spring holder 25 by the locking arm 20 is released and the spring force of the two coiled springs 41 pushes the spring holder 25 backwards. Then the upper edge protrusions 46 make contact with the upper edge stopping protrusions 48 and the lower edge protrusions 50 make contact with the lower edge stopping protrusions 52, thereby halting the retreat of the spring holder 25.

Figure 15:
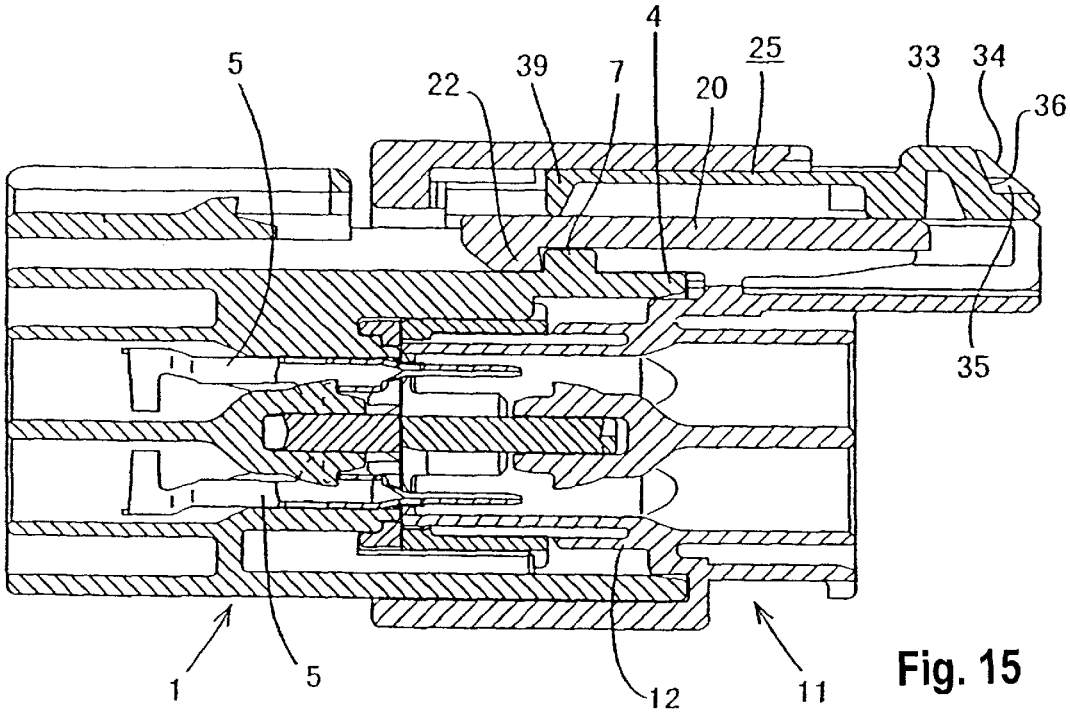
FIG. 15 is a vertical cross-sectional view showing the spring holder in a retreated state.
Figure 16:
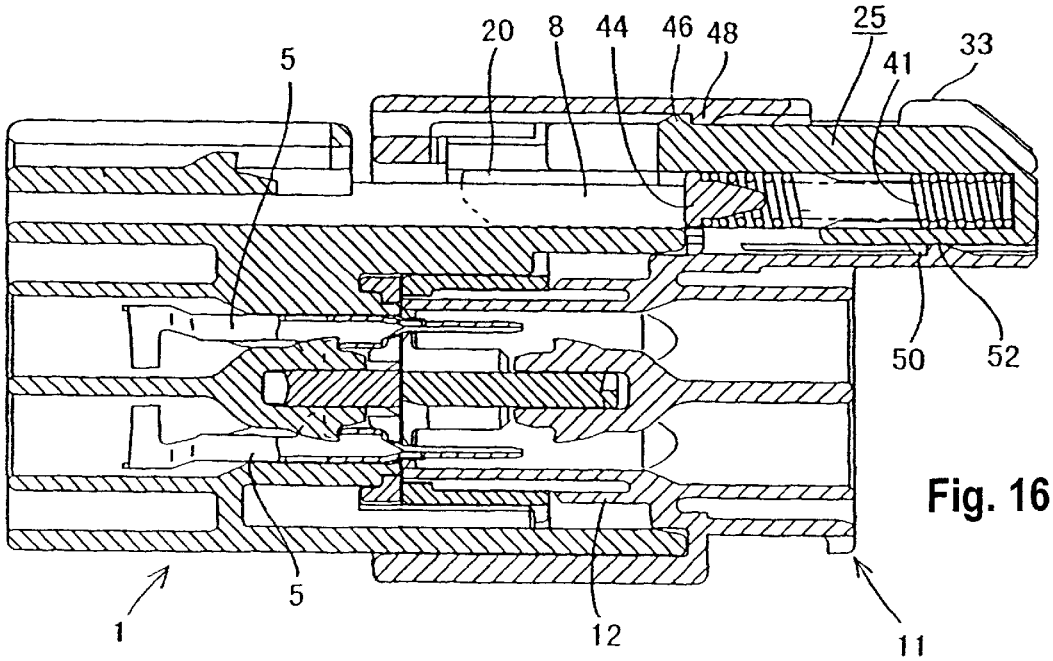
FIG. 16 is a vertical cross-sectional view of the installed portion of the coiled springs at the same juncture as FIG. 15.

In this manner, as shown in FIGS. 15 and 16, the fitting of the locking claw 22 and the stopping protrusion 7 locks the two housings 1 and 11 in a fitted state, and the electrical connection of the male and female terminal fittings is completed. Further, the coiled springs 41 regain almost their natural length due to the posterior movement of the spring holder 25 and, as a result, do not exert a separating force on the two housings 1 and 11 when these are in a completely fitted state.

Moreover, in the completely fitted state, the restraining wall 39 of the spring holder 25 is pushed onto the anterior end of the locking arm 20. This constitutes a double stopping of the stopping protrusion 7, and a more reliable locked state can thus be achieved.

When the two housings 1 and 11 are to be separated, from the state shown in FIGS. 15 and 16, either the operating face 34 of the releasing operating member 32 is pressed in a perpendicular manner, or a jig is inserted into the jig hole 35 and used to press the contacting face 36 in a perpendicular manner. Thereupon, an anterior component force is exerted first, compressing the coiled springs 41 and pushing the spring holder 25 in an anterior direction, the two supporting arms 54 again being engaged by the hook members 58. At this juncture, the spring holder 25 returns to its original location, the restraining wall 39 of the spring holder 25 passing the location of the anterior end of the locking arm 20. Consequently, the releasing operating member 32 is pushed downwards by a downwards component force, this pushing the posterior end of the locking arm 20, the anterior end of the locking arm 20 being caused to rise up forcefully, and the locking claw 22 being released from the stopping protrusion 7. In this manner the two housings 1 and 11 can be separated.

According to the present embodiment, as described above, the configuration is characterised in that the contacting face provided on the restraining wall 39 is a tapered face 40, this tapered face 40 engaging the anterior end of the locking arm 20 and regulating the return of the spring holder 25.

That is, when the two housings 1 and 11 are fitted together completely and the locking claw 22 of the locking arm 20 passes over the stopping protrusion 7, the locking arm 20 thereby being in a state in which it can return to its original position, the restraining wall 39 is pushed against the anterior end of the locking arm 20, the spring force F of the coiled springs 41 being exerted in a horizontal direction. At this juncture, there is the danger that the frictional force between the restraining wall 39 and the anterior end of the locking arm 20 may prevent the locking arm 20 from returning. However, since the contacting face is the tapered face 40, the spring force F of the coiled springs 41 extends along the tapered face 40 and a component force F1 is obtained which causes the locking arm 20 to move in a returning direction. This component force F1 and the resilient returning force of the locking arm 20 itself cause the locking arm 20 to return smoothly to its original position.

Consequently, when the two housings 1 and 11 are correctly fitted together, the locking arm 20 can be made to return to its original position and can be locked in a reliable manner.

Figure 17:
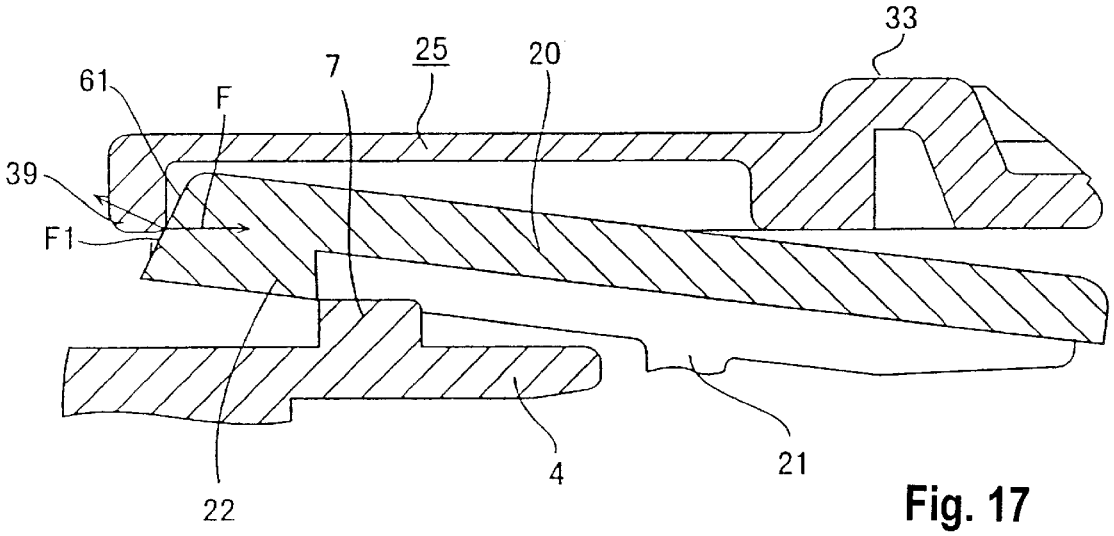
FIG. 17 is a partially enlarged cross-sectional view of a second embodiment of the present invention showing the locking arm having risen over the stopping protrusion.

FIG. 17 shows a second embodiment of the prevent invention. Unlike the first embodiment, this second embodiment has a tapered face 61 on the anterior end face of the locking arm 20 which makes contact with the restraining wall 30 of the spring holder 25.

In this configuration also, when the locking claw 22 of the locking arm 20 rises over the stopping protrusion 7 and the locking arm 20 is in a state in which it can return to its original position, the spring force F of the coiled springs 41 is exerted in a horizontal direction. Consequently, the spring force F extends along the tapered face 61 and a component force F1 is obtained which causes the locking arm 20 to move in a returning direction. This component force F1 and the resilient returning force of the locking arm 20 itself cause the locking arm 20 to return smoothly to its original position.

Figure 18:
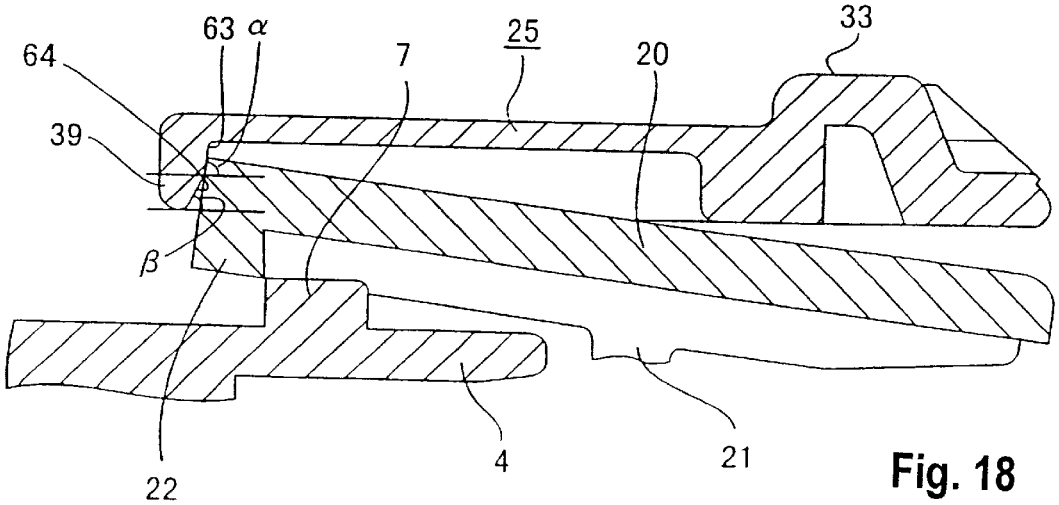
FIG. 18 is a partially enlarged cross-sectional view of a third embodiment showing the locking arm having passed over the stopping protrusion.
Figure 19:
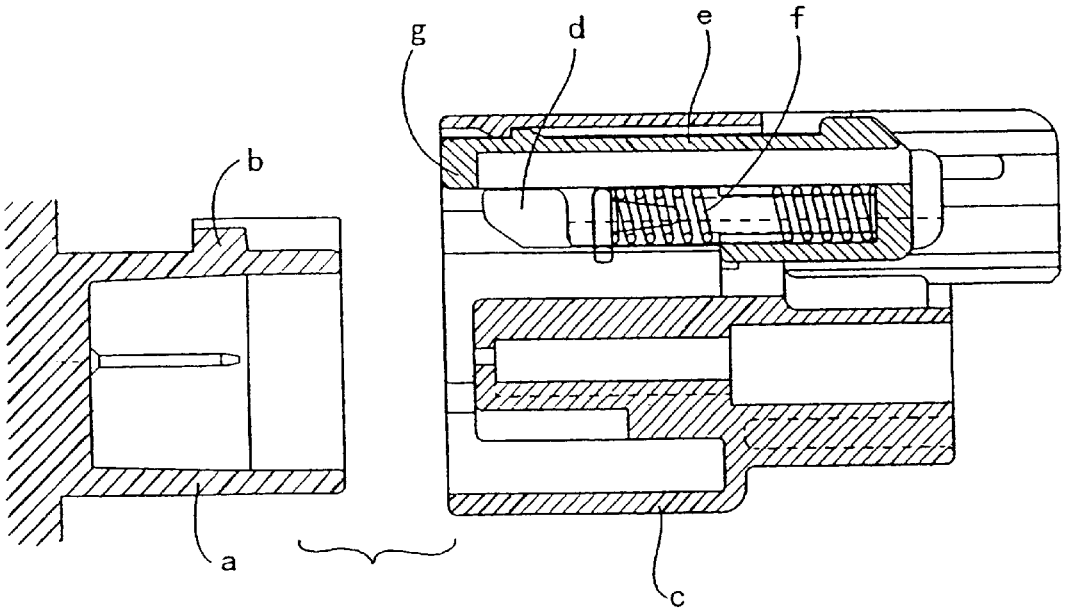
Fig. 19 PRIOR ART
FIG. 19 is a vertical cross-sectional view of a prior are connector.
Figure 20:
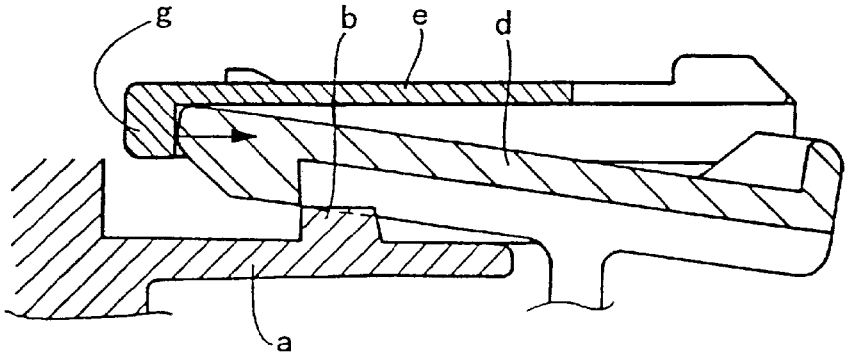
Fig. 20 PRIOR ART
FIG. 20 is a partially enlarged cross-sectional view of the prior art connector of FIG. 19 showing a locking arm having passed over a stopping protrusion.

FIG. 18 shows a third embodiment of the present invention. In embodiment 1, when a component force is obtained from the resilient force of the coiled springs 41 to push the locking arm 20 in a returning direction, the smaller the angle of the tapered face of the restraining wall 39 relative to the direction of compression of the coiled springs 41, the greater the component force obtained. On the other hand, a smaller angle results in a weakening of the stopping force exerted against the retreating direction of the spring holder 25. In particular, in the case where the contacting face is at a small angle with respect to the direction of compression of the coiled springs 41 and the bending of the locking arm 20 is great when the coiled springs 41 exert a strong resilient force, there is the danger that the spring holder 25 slides backwards.

For this reason, in the third embodiment, the contacting face provided on the restraining wall 30 of the spring holder 25 consists of two steps having differing angles of inclination, these being tapered faces 63 and 64. That is, if the bending of the locking arm 20 is large, the locking arm 20 makes contact with the upper tapered face 63, and the angle $\alpha$ with respect to the direction of compression of the coiled springs 41 will be larger. When contact is made with the lower tapered face 64, the angle $\beta$ with respect to the direction of compression of the coiled springs 41 will be smaller.

According to this configuration, if the bending of the locking arm 20 is large when it rises over the stopping protrusion 7, the locking arm 20 will make contact with the upper tapered face 63 having the large angle $\alpha$. As the fitting operation of the two housings 1 and 11 continues, the resilient returning force of the coiled springs 41 will gradually increase. However since the angle $\alpha$ of the tapered face 63 is large, the stopping force with respect to the returning direction of the spring holder 25 is maintained.

Further, when the locking claw 22 of the locking arm 20 rises over the stopping protrusion 7 and the locking arm 20 is in a state in which it can return, the resilient returning force of the coiled springs 41 is itself large so as to provide an adequate component force which pushes the locking arm 20 in a returning direction even though the anterior end of the locking arm 20 makes contact with the tapered face 63 having the large angle $\alpha$. If the locking arm 20 begins to return and makes contact with the lower tapered face 64 having the small angle $\beta$, a larger component force can be obtained for moving the locking arm 20 in a returning direction, and the locking arm 20 will return smoothly.

That is, the premature return of the spring holder 25 can be reliably prevented. A large component force can also be obtained to move the locking arm 20 in a returning direction so that the return of the locking arm 20 is carried out more smoothly.

Moreover, if a tapered face is provided on the anterior end face of the locking arm 20, as in the second embodiment, this face can consist of two steps having differing angles of inclination and identical operation so that effects will be obtained. That is, the two steps are arranged so that when the bending of the locking arm 20 is large, the angle relative to the direction of compression of the coiled springs 41 will be large at the lower step on the anterior end face of the locking arm 20, this lower step making contact with the restraining wall 39; and when the bending of the locking arm 20 is small, the upper step making contact with the restraining wall 39 is inclined so that a small angle is formed relative to the direction of compression of the coiled springs 41.

Furthermore, the present invention is not limited to the embodiments described above with the aid of figures. For example, the possibilities described below also lie within the technical range of the present invention. In addition, the present invention may be embodied in the following ways without deviating from the scope thereof.

(1) The tapered face may be divided into three or more steps having differing angles of inclination, or the differing angles may be provided in a continuous manner.

(2) In place of the coiled springs, plate springs or other spring means may be used.

(3) Further, the spring holder and the locking arm need not be provided on the female housing but may equally well be provided on the male housing.

What is claimed is:

1. An electrical connector assembly comprising a first connector housing and a second connector housing each having at least one terminal, the first connector housing including a locking protrusion, the second connector housing including a locking arm bendable from an unbent rest condition to a bent condition on initial engagement with the locking protrusion of the first connector housing as the first and second connector housings are fit together and to an unbent latched condition to latch the locking arm and the locking protrusion when the first and second connector housings are fully fitted together, the locking arm having a free end with a projection to engage the locking protrusion, a spring holder having a forward portion with a restraining wall, and a compression spring positioned in the spring holder and compressible between the spring holder and the first connector housing to apply a force along an axis to urge the second connector housing out of engagement with the first connector housing during partial fitting thereof, wherein the free end of the locking arm engages a rear face of the restraining wall when the locking arm is in the bent condition during partial fitting of the first and second connector housings so as to move the spring holder forward with the second connector housing toward the first connector housing to thereby compress the spring, the restraining wall of the spring holder and the free end of the locking arm are released from each other upon latching of the locking arm and the locking protrusion to permit rearward movement of the spring holder so that compressive stress in said spring is reduced, one of the restraining wall of the spring holder or the free end of the locking arm has a tapered abutment face that contacts the other of the restraining wall of the spring holder or the free end of the locking arm when the locking arm is in the bent condition, and the tapered abutment face is inclined relative to the axis prior to fitting the connector housings together such that under the urging of said spring the tapered abutment face urges the locking arm to the unbent latched condition.

2. A housing according to claim 1 wherein said tapered abutment face is provided on the end of said locking arm.

3. A housing according to claim 1 wherein said tapered abutment face is provided on said restraining wall of spring holder.

4. A housing according to claim 1 wherein said tapered abutment face is inclined at an angle of 50–75° with respect to the axis.

5. A housing according to claim 1 wherein said tapered abutment face has two facets at angles relative to the axis.

* * * * *

UNITED STATES PATENT AND TRADEMARK OFFICE

CERTIFICATE OF CORRECTION

PATENT NO. : 6,383,009 B2 
DATED : May 7, 2002
INVENTOR(S) : Hajime Kawase, Satoru Nishide and Ryotaro Ishikawa It is certified that error appears in the above-identified patent and that said Letters Patent is hereby corrected as shown below:

Column 4,
Line 13, change "being" to -- are --.

Column 5,
Line 56, change "jut" to -- just --.

Column 10,
Line 28, insert -- said -- before "spring".

Signed and Sealed this

Eighteenth Day of June, 2002

*Attest:*

*Attesting Officer*

JAMES E. ROGAN
*Director of the United States Patent and Trademark Office*